United States Patent [19]

Ebata et al.

[11] Patent Number: 4,653,743

[45] Date of Patent: Mar. 31, 1987

[54] FEEDING DEVICE

[75] Inventors: Tokihide Ebata, Tanashi; Shigeyoshi Onoda, Yokohama, both of Japan

[73] Assignee: Canon Kabushiki Kaisha, Tokyo, Japan

[21] Appl. No.: 625,645

[22] Filed: Jun. 28, 1984

[30] Foreign Application Priority Data

Jul. 4, 1983 [JP] Japan ..... 58-120250

[51] Int. Cl.[4] ..... B65H 3/52

[52] U.S. Cl. ..... 271/124; 271/138; 271/167

[58] Field of Search ..... 271/121, 124, 137, 138, 271/165, 167; 221/251, 312 R

[56] References Cited

U.S. PATENT DOCUMENTS

| | | | |
|---|---|---|---|
| 2,448,303 | 8/1948 | Fors | 271/138 |
| 3,290,042 | 12/1966 | Johnson et al. | 271/138 |
| 4,405,124 | 9/1983 | Watanabe | 271/138 |

FOREIGN PATENT DOCUMENTS

| | | | |
|---|---|---|---|
| 0000297 | 1/1977 | Japan . | |
| 0043143 | 4/1981 | Japan | 271/121 |

*Primary Examiner*—Richard A. Schacher

*Attorney, Agent, or Firm*—Fitzpatrick, Cella, Harper & Scinto

[57] ABSTRACT

This invention provides a sheet feeding device suitable for use as a paper feeding device in an image forming apparatus such as a copying apparatus. The feeding device is provided with a sheet receiving portion for supporting thereon a number of sheets in superposed relationship, and means for passing therethrough the endmost one of the sheets supported on the sheet receiving portion. The feature of the invention resides that a control member vertically movable as viewed in the direction of superposition of the sheets to direct only the endmost sheet to the means is provided between the leading end edge of the superposed sheets and the means.

1 Claim, 9 Drawing Figures

FEEDING DEVICE

BACKGROUND OF THE INVENTION

1. Field of the Invention

This invention relates to a sheet feeding device suitable for use as a feeding device in an image forming apparatus such as a copying apparatus.

2. Description of the Prior Art

In image forming apparatuses such as copying apparatuses, it has usually been the practice that paper sheets of a predetermined format each having a weight of about 60 to 90 g/m$^2$ are used and superposed one upon another in a cassette or other suitable reservoir and the cassette or the like is received in the image forming apparatus and such superposed paper sheets are taken out one by one from the uppermost paper sheet.

FIG. 1 of the accompanying drawings shows the essential portions of a conventional paper feeding device used in an image forming apparatus. In a cassette C brought to a predetermined position in the image forming apparatus, there are received a number of sheets of copying paper P superposed on a bed plate 4 biased upwardly by a spring 3. The sheets of copying paper P are maintained in place with the opposite corners of the leading end thereof restrained by separating pawls 2 (only one of which is shown). When the cassette is within the image forming apparatus, a friction ring 1*a* disposed around a paper feeding roller 1 provided in the copying apparatus bears against the uppermost sheet of copying paper and, when the paper feeding roller 1 is rotated clockwise in timed relationship with the various portions of the apparatus, one sheet of copying paper somewhat flexes because the leading end edge of the copying paper is held by the separating pawls, and then that copying paper is disengaged from the separating pawls due to the rigidity of the paper itself and thereafter is moved onto a conveyance path 5 by the paper feeding roller.

Such a paper feeding system is suitable in the case of copying paper having a predetermined range of weight as previously described, but especially in a case where thick paper having a greater weight is to be fed, the cooperative operation of the separating pawls and the paper feeding roller does not suitably act and thus, the paper unavoidably fails to be well disengaged from the separating pawls and is broken or cannot be fed. Accordingly, in such a case, paper feeding has often been effected manually.

However, recently, compact image forming apparatuses producing a relatively small number of image bearing sheets and suitable for use by the users have become used habitually and along therewith, the cases where copying is effected on a considerable number of small-sized thick sheets such as post cards by the use of a copying apparatus instead of printing have increased.

As the means for handling such thick sheets, there has already been proposed the one as schematically shown, for example, in FIG. 2 of the accompanying drawings. This means is basically similar to that shown in FIG. 1 in that a number of paper sheets are received in a cassette and are successively fed by the use of a paper feeding roller, but in this means, no separating pawl is provided and a front regulation plate 6*b* is disposed at the leading end edge of paper sheets and an upper regulation plate 6*a* is disposed on the upper surface of the paper sheets and a gap 6*c* which will permit a paper sheet to pass therethrough is provided therebetween so that the paper sheets may be taken out one by one from the gap 6*c* by the paper feeding roller 1.

However, it can be readily understood that in the means of such construction, paper feeding cannot be accomplished successfully if paper sheets are curled. Also, if an attempt is made to place a superposed matter on the leading end of the paper sheets to suppress the curl thereof or an attempt is made to strengthen a spring 3 to forcibly correct the curl of the paper sheets, the resistance becomes greater and this also has unavoidably led to a disadvantage that feeding of the paper sheets cannot be accomplished smoothly.

To eliminate such a disadvantage, a construction in which superposed sheet materials may be successively taken out from the lowermost sheet material as shown, for example, in FIG. 3 of the accompanying drawings has already been proposed.

FIG. 3 shows a case where the feeding device is applied to the paper feeding device of an image forming apparatus. In a cassette C receiving therein a number of sheets of copying paper, especially, thick paper sheets, and mounted at a predetermined position within the image forming apparatus, a front regulation plate 7 is provided so as to have a gap 7*a* which permits a sheet of copying paper to pass therethrough, at the front lower end of the cassette as viewed in the direction of feeding of the copying paper, and a slot 8*a* extending in the direction of feeding of the copying paper is provided in the bottom plate 8 of the cassette.

A lever 10 is pivotably mounted on a pin 9 provided at a suitable location in the image forming apparatus, and a slot 10*a* is formed in one end (the lower end as viewed in the Figure) of this lever, a shaft 12 being slidably engaged with this slot 10*a*. Further, the shaft 12 is fitted in a slot 17*a* (which extends parallel to the direction of feeding of the copying paper at a suitable location in the bed portion on which the cassette rests or other immovable portion 17 of the image forming apparatus), and the shaft 12 is designed to be slidable but not rotatable in the slot 17*a*. FIG. 4 of the accompanying drawings shows an example of the mechanism therefor. A cut-away portion 12*a* is formed flatly in a portion of the shaft 12 and the edge portion of the slot 17*a* is adapted to be engaged with the flat cut-away portion, and the shaft 12 is movable in the slot 17*a* in a direction perpendicular to the plane of the drawing sheet of FIG. 4 but is not rotatable because the cut-away portion 12*a* is engaged with the edge portion of the slot 17*a*. Of course, the means for rendering the shaft 12 slidable but unrotatable is not restricted thereto.

Further, at least one paper feeding roller 13 is rotatably disposed on the shaft 12 and a one-way clutch 14 is secured thereto. This clutch may be engaged and disengaged with the paper feeding roller 13 to rotate the same roller only in the direction of arrow B in FIG. 3.

On that side of the lever 10 which is opposite to the side on which the paper feeding roller is disposed, the other end of a spring 11 having one end secured to a suitable location in the image forming apparatus is secured, whereby the lever 10 is biased in the direction indicated in FIG. 3. Further, the end portion 10*b* of the lever 10 bears against a movable member 15 such as the movable original supporting table of the image forming apparatus.

The paper feeding device is generally of the above-described construction. As the movable member 15 is moved from its solid-line position of FIG. 3 to its dots-and-dash line position in timed relationship with the operation of the various members in the image forming apparatus, the lever 10 pivots to its dots-and-dash line position. Along therewith, the paper feeding roller 13 at the other end of this lever is not rotated but is moved leftwardly along the slot 10*a* of the lever and the slot 17*a* provided in the immovable portion of the apparatus. At this time, the one-way clutch 14 is engaged with the paper feeding roller 13 and does not rotate the latter and thus, the lowermost sheet of copying paper in the cassette is discharged through the gap 7*a* due to the friction between this roller and said lowermost sheet of copying paper.

After the discharged copying paper has been reliably fed into the image forming apparatus, the lever 10 is returned to its solid-line position of FIG. 3 by the action of the spring 11, but at this time, the engagement between the paper feeding roller 13 and the one-way clutch 14 is released and therefore, the roller 13 is free to rotate and accordingly, the friction thereof with the copying paper in the cassette which bears thereagainst is small and the lever can readily return to said solid-line position without affecting the copying paper in any way.

As described previously, where thick copying paper sheets are received in the cassette, if the copying paper sheets are curled, the lowermost paper sheet in the cassette is not opposed to the discharge gap 7*a* of the cassette as shown in FIG. 5 of the accompanying drawings and therefore, paper feeding would not be accomplished successfully. Recently, image forming apparatuses in which a cartridge comprising a plurality of photosensitive mediums and developing devices containing developers of different colors is prepared and this cartridge is interchanged to obtain copies of plural colors have become often used, but in such a case, curling of the copying paper is liable to occur when it is heated to fix the image of a first color, and such curled portion is liable to hamper the paper feeding when automatic paper feeding is effected again by the paper feeding device for the formation of the image of a second color.

In order to eliminate such an inconvenience, it would occur to mind to place a weight on top of the copying paper sheets in the cassette and forcibly correct the produced curl temporally, but if this is done, the load applied to the paper feeding roller will become great and also, even if a weight is applied only to the forward portion of the copying paper sheets in the cassette, the burden of the conveyor roller in the conveyance path applied to a discharged sheet of copying paper will become great, and this is not preferable as previously described.

SUMMARY OF THE INVENTION

The present invention has been made in view of the above-noted disadvantages peculiar to the sheet feeding device according to the prior art and an object thereof is to provide a sheet feeding device which reliably corrects the curl of sheet materials, for example, in a cassette to thereby enable the sheet materials to be discharged one by one and which can reduce as much as possible the load applied to the feeding roller or the conveyor rollers disposed in the sheet conveyance path after discharge.

That is, the feeding device of the present invention is one in which a number of especially thick sheet materials superposed one upon another, for example, in a cassette are taken out successively from the lowermost sheet material and wherein a vertically movable control plate is provided at the fore end with respect to the direction of movement of the sheet materials, whereby movement of the other sheet materials than the lowermost sheet material may be suppressed and therefore, for example, even curled sheets can be reliably discharged one by one.

DESCRIPTION OF THE PREFERRED EMBODIMENT

The present invention will hereinafter be described with respect especially to a paper feeding device for feeding thick copying paper such as post cards in an image forming apparatus such as a copying apparatus by reference to the accompanying drawings.

Figure 1:
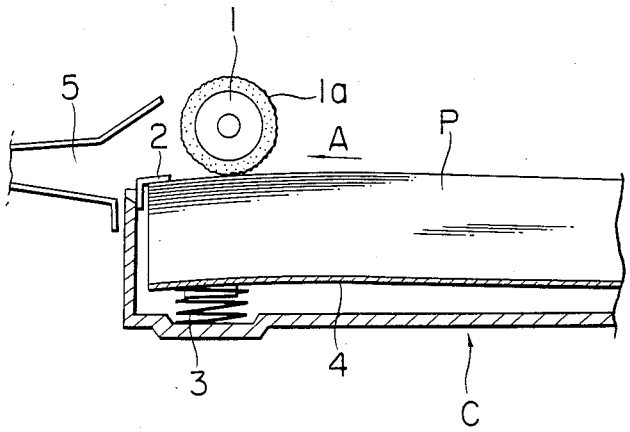
FIG. 1 (PRIOR ART)
FIG. 1 is a side cross-sectional view of the essential portions for illustrating the operation of a paper feeding device according to the prior art.
Figure 2:
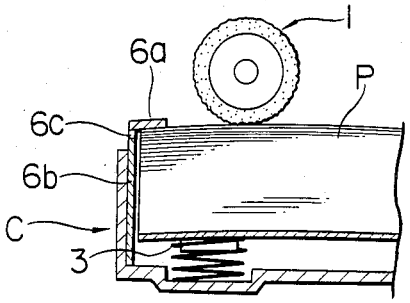
FIG. 2 (PRIOR ART)
FIG. 2 is a side cross-sectional view of the essential portions of another feeding device according to the prior art.
Figure 3:
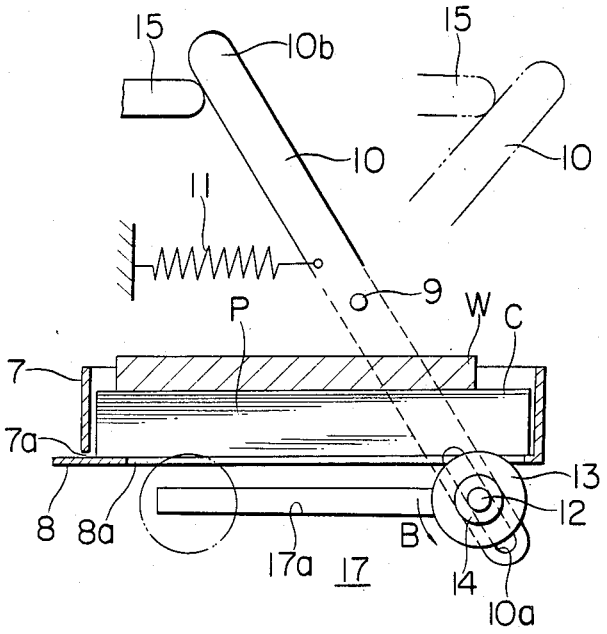
FIG. 3 (PRIOR ART)
FIGS. 3 and 4 are a schematic side view and an end view, respectively, showing the construction of still another paper feeding device according to the prior art.
Figure 4:
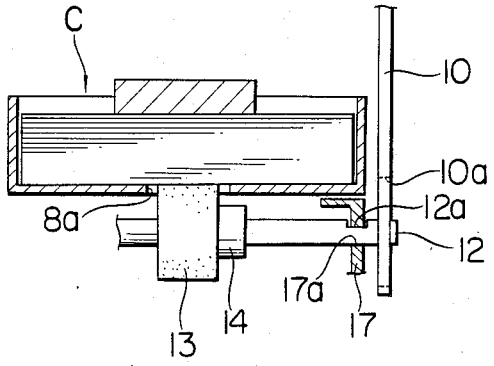
FIG. 4 (PRIOR ART)
Figure 5:
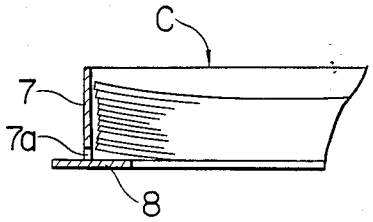
FIG. 5 (PRIOR ART)
FIG. 5 is a fregmentary cross-sectional view of a cassette in which sheets of curled copying paper are received.
Figure 6:
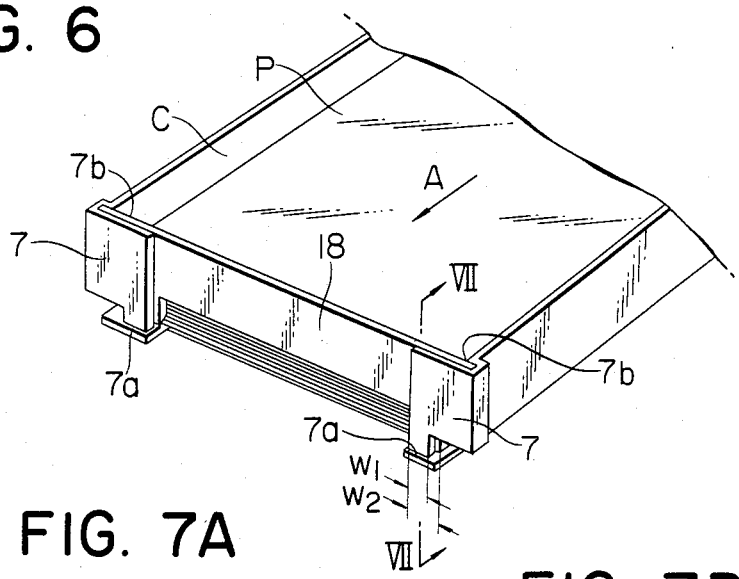
FIG. 6 is a perspective view showing the essential portions of an embodiment of the present invention.

FIG. 6 is a fragmentary perspective view showing only the cassette portion in a paper feeding device similar to that shown in FIGS. 3 and 4. It is to be understood that the sheets of copying paper P in the cassette are moved in the direction of arrow A. Regulation plates 7 and 7 are formed on the opposite sides of the fore edge of the cassette, and gaps 7*a* and 7 a which permit only one sheet of copying paper to pass therethrough as in the example shown in FIG. 3 are formed between the lower ends of the regulation plates and the bottom surface of the cassette.

Disposed adjacent to the regulation plates 7 and inside the cassette is a control plate 18 loosely fitted in grooves 7*b* provided at the opposite sides of the fore end of the cassette, the control plate 18 being vertically movable.

Figure 7A:
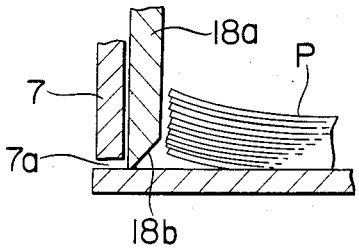
FIGS. 7A to 7C are cross-sectional views of the essential portions illustrating the manner in which curled sheet materials are discharged.

In the portions proximate to the gaps 7*a* and 7*a* at the lower ends of the regulation plates 7 and 7, the control plate 18 is formed with downwardly extending portions 18*a* and, as can be seen in FIG. 7A, the inner sides of these downwardly extending portions are formed with tapered portions 18*b*.

Description will now be made of the copying paper feeding action by the cassette provided with the construction as described above.

A cross-section taken along line VII—VII of FIG. 6 and showing the portion near the fore edge when sheets of thick copying paper P curled at the end portion thereof for the various reasons as previously described are received in the cassette C is shown in FIG. 7A.

Figure 7B:
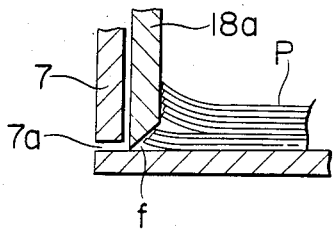
Figure 7C:
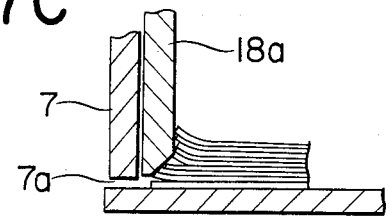

When a leftward conveying action is imparted to the lowermost one of the sheets of copying paper P received in such a condition by the paper feeding mechanism as shown in FIGS. 3 and 4, the lowermost sheet of copying paper or several sheets of copying paper adjacent thereto are forced to move by such action and as shown in FIG. 7B, they bear against the tapered portion 18*b* of the control plate 18 to thereby raise the control plate 18 upwardly while crawling into a wedge-shaped portion f formed by the tapered portion 18*b* and the bottom surface of the cassette. At this time, the weight of the control plate 18 is applied to the curled end portions of the sheets of copying paper and the sheets of copying paper advance while the curl thereof is corrected and thus, only the lowermost sheet of copying paper is discharged from the gaps *7a* now opened by the upward movement of the control plate 18 as shown in FIG. 7C, and at this time, the sheets of copying paper overlying the lowermost sheet of copying paper come into engagement with the tapered portion 18*b* and are thereby prevented from advancing and therefore, unless the weight of the control plate 18 is too great or the control plate is in a freely vertically movable condition, two or more sheets of copying paper will not clog the gaps.

In the above-described embodiment, the control plate 18 is designed to be capable of falling until it contacts the bottom surface of the cassette, but it may be designed by the use of a suitable stopper or the like such that it can only fall to a position in which it floats with respect to the bottom surface to a degree corresponding to the thickness of the sheets in the cassette, whereby the resistance during the conveyance can be further decreased.

Further, in the embodiment shown in FIG. 6, the width $W_1$ of the lower ends of the control plates 7 and the width $W_2$ of the protruded lower end portion of the control plate 18 may preferably be in the range of $W_1<W_2<2W_1$. According to the experiment, when the gap d was d =0.3 mm and the angle formed by the tapered portion 18*b* of the control plate 18 with respect to the bottom surface of the cassette was 60° and the thickness of the control plate 18 was 1.2 mm and $W_1$ was $W_1=3.6$ mm and $W_2$ was $W_2=7$ mm, post cards could be smoothly discharged with the weight of the control plate 18 being 17 gr.

What I claim is:

1. A feeding device provided with sheet receiving means for supporting thereon a number of paper sheets in a superposed relationship, said device comprising:

gate means for forming a gap for receiving only one paper sheet at a time;

feeding means for successively feeding the lowermost one of said paper sheets supported on said sheet receiving means toward said gap; and sheet-passage control means provided between said gate means and the leading edges of said superposed paper sheets, and provided with a tapered portion on a surface facing said leading edges of said superposed paper sheets, said control means being pushed up by the leading edges of said paper sheets in an upward direction crossing a sheet forwarding direction during the feed operation, and then descending to push the leading edges of said paper sheets so as to flatten the same, wherein said control means leads the leading edge of only the lowermost paper sheet being fed to pass through said control means to said gap.

* * * * *